US005330362A

United States Patent [19]

Ito et al.

[11] Patent Number: 5,330,362

[45] Date of Patent: Jul. 19, 1994

[54] LOW-OPERATING-FORCE CONNECTOR

[75] Inventors: Keiichi Ito; Hirotaka Noda; Nobutoshi Hagiwara, all of Aichi; Naoto Taguchi, Shizuoka; Yuji Hatagishi, Shizuoka; Toshifumi Matsuura, Shizuoka, all of Japan

[73] Assignee: Yazaki Corporation, Tokyo, Japan

[21] Appl. No.: 32,005

[22] Filed: Mar. 16, 1993

[30] Foreign Application Priority Data

Apr. 3, 1992 [JP] Japan ..... 4-020077

[51] Int. Cl.[5] ..... H01R 13/62

[52] U.S. Cl. ..... 439/157

[58] Field of Search ..... 439/152-160, 439/372, 271, 278, 281

[56] References Cited

U.S. PATENT DOCUMENTS

| | | | |
|---|---|---|---|
| 2,987,693 | 6/1961 | Wamsley | 439/157 |
| 4,486,062 | 12/1984 | Kasugai | 439/271 |
| 5,135,410 | 8/1992 | Kawase et al. | 439/157 |
| 5,174,785 | 12/1992 | Endo et al. | 439/157 |

FOREIGN PATENT DOCUMENTS 52-133993 10/1977 Japan .

*Primary Examiner*—David L. Pirlot

*Attorney, Agent, or Firm*—Finnegan, Henderson, Farabow, Garrett & Dunner

[57] ABSTRACT

The low-operating-force connector consists of a pair of female and male housings. The male housing has on the opposite sides driven pins, while the female housing has pin guide grooves for the driven pins. A cam member is rotatably mounted on the female housing, which consists of levers each including a cam groove and a lever handle connecting the levers. The housings are fitted with or separated from each other through rotation of the cam member. A pair of resilient locking pieces are provided on the outer periphery of the male housing, the locking pieces each including an engagement projection, while a corresponding pair of engagement portions are provided on the lever handle. Springs are so provided between the levers of the cam member and the female housing as to urge the cam member into an upright opened position. On completion of the coupling of the female and male housings, the cam member is locked by the engagement between the engagement projections and portions. When the engagement projections and portions are disengaged, the cam member is opened by the resilient action of the springs up to a starting position for separating the housings.

4 Claims, 7 Drawing Sheets

LOW-OPERATING-FORCE CONNECTOR

BACKGROUND OF THE INVENTION

1. Field of the Invention

This invention relates to an improvement in low-operating-force connectors in which a pair of female and corresponding male housings are fitted with and separated from each other through rotation of a cam member provided with levers.

2. Description of the Prior Art

An example of such a connector is disclosed in Japanese Utility Model Preliminary Publication No. Showa 52-133993, in which, with a view to providing a structure whereby a pair of receptacle-side and plug-side connectors with multiple and complementary terminals therein are coupled and separated with a low operating force, an engaging projection and an engaging lever are respectively formed on one and the other of the connectors such that they are brought into and out of engagement with each other through rotation of the lever.

Shown in FIG. 7 is a lever-including connector according to the prior art as mentioned above, in which a represents a female connector directly fixed to a wall p of an electric instrument such as an electric junction box (or a panel) and b a male connector. Projections c are provided on the opposite lateral walls of the female connector a and levers d each with a cam groove e are rotatably provided on the opposite lateral walls of the male connector b such that they cooperate with each other to couple and decouple the connectors through rotation of the levers d. In the figure, denoted f is a stopper for the lever d and g a locking spring which engages with the lever d to lock the same from accidental movement to prevent separation of the female and male connectors a and b.

With the connector of FIG. 7, however, the lever d can be operated with one hand to cause unlocking only when one of the connectors, female a is fixed to a firm member such as a panel or wall p of an electric instrument as in FIG. 7. When the structure is applied, e.g., to a female and a male connectors for interconnecting wiring harnesses, since neither of the connectors is fixed in position, both hands must necessarily be used to unlock the connectors, causing inconvenience and inefficiency in operations in a confined space such as in an automobile. In addition, since locking means (locking spring 2) is provided on the male connector b, which is capable of locking the lever d prior to and independently of the coupling of the connectors, the locking of the lever d by the locking means may result in misunderstanding that the coupling of the connectors has been completed. Further, where the levers d are in a locked position prior to the fitting of the connectors, it is first necessary to release the levers d from the locking means and, prior to rotating the levers 4, to move the levers d so as to align their cam grooves d with the associated projections c, which is very troublesome.

SUMMARY OF THE INVENTION

The present invention has been accomplished to overcome the above drawbacks and one of its objects is to provide a low-operating-force connector in which the cam member can be easily operated with one hand to unlock the female and male connectors in their separation, and in which the connectors can be directly fitted with each other without the necessity of correcting the posture of the cam member.

To attain the above object, the low-operating-force connector of this invention comprises, as stated in claim 1: a female housing and a corresponding male housing; driven pins provided on opposite sides of one of said housings; pin guide grooves formed on opposite sides of the other of said housings for guiding said driven pins; a cam member substantially in a gate-like configuration comprising a pair of levers each having a cam groove formed therein and a lever handle interconnecting said levers, said levers movably mounted on a respective one of said opposite sides of said second-named housing with their cam grooves in alignment with said pin guide grooves so that through rotation of said cam member or levers, said driven pins are brought into and out of engagement with said levers to lock together or unlock said female and male housings; a pair of resilient locking pieces provided on said first-named housing, each having on its outer periphery an engagement projection and resiliently displaceable in a direction parallel to a wall surface on which it is provided; a pair of engagement portions provided on said lever handle of the cam member for engagement with said engagement projections of the resilient locking pieces; and spring means disposed between said levers of the cam member and said second-named housing for normally urging said cam member into an upright opened position, whereby when said female and male housings are completely fitted with each other through rotation of said cam member to a closed leaning position on said first-named housing, said engagement projections of the resilient locking pieces engage with said engagement portions to lock said cam member in the closed position, and whereby when said engagement portions are released from said engagement projections of the resilient locking pieces, said cam member is opened by a resilient action of said spring means up to a starting position for separating said female and male housings.

In operation, since a spring is interposed between the lever of the cam member and the hood portion of the female housing, which normally urges the cam member into an upright opened position and aligns the cam groove with the pin guide groove, the male housing can simply be inserted as it is into the female housing to be fitted therewith. To decouple the housings, the pair of resilient locking pieces on the male housing are pushed toward each other with fingers to release the engagement portions of the cam member therefrom, and the cam member is automatically opened by the resilient action of the spring to a starting position for separating the female and male housings. As a result, operations within a confined space are facilitated. Further, since the cam member is not locked until after the female and male housings are fully fitted, incomplete coupling can be prevented.

The above and other objects, features and advantages of the present invention will become apparent from the following description and the appended claims, taken in conjunction with the accompanying drawings in which like or corresponding parts are denoted by like reference characters through all of the figures.

DETAILED DESCRIPTION OF THE PREFERRED EMBODIMENT

Figure 1:
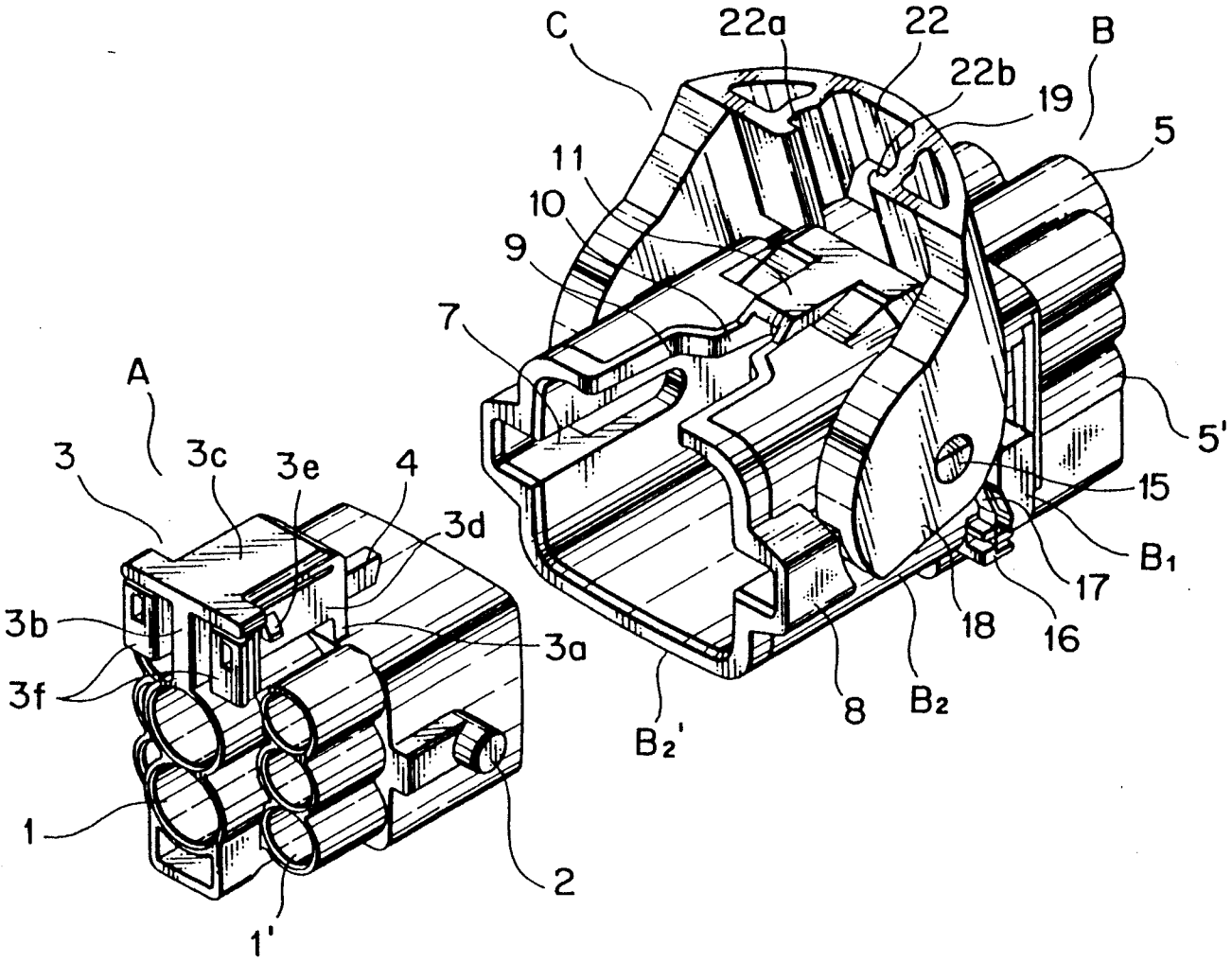
FIG. 1 is a perspective view of a female and a male housings of a low-operating-force connector as one embodiment of the invention shown separated from each other.
Figure 2:
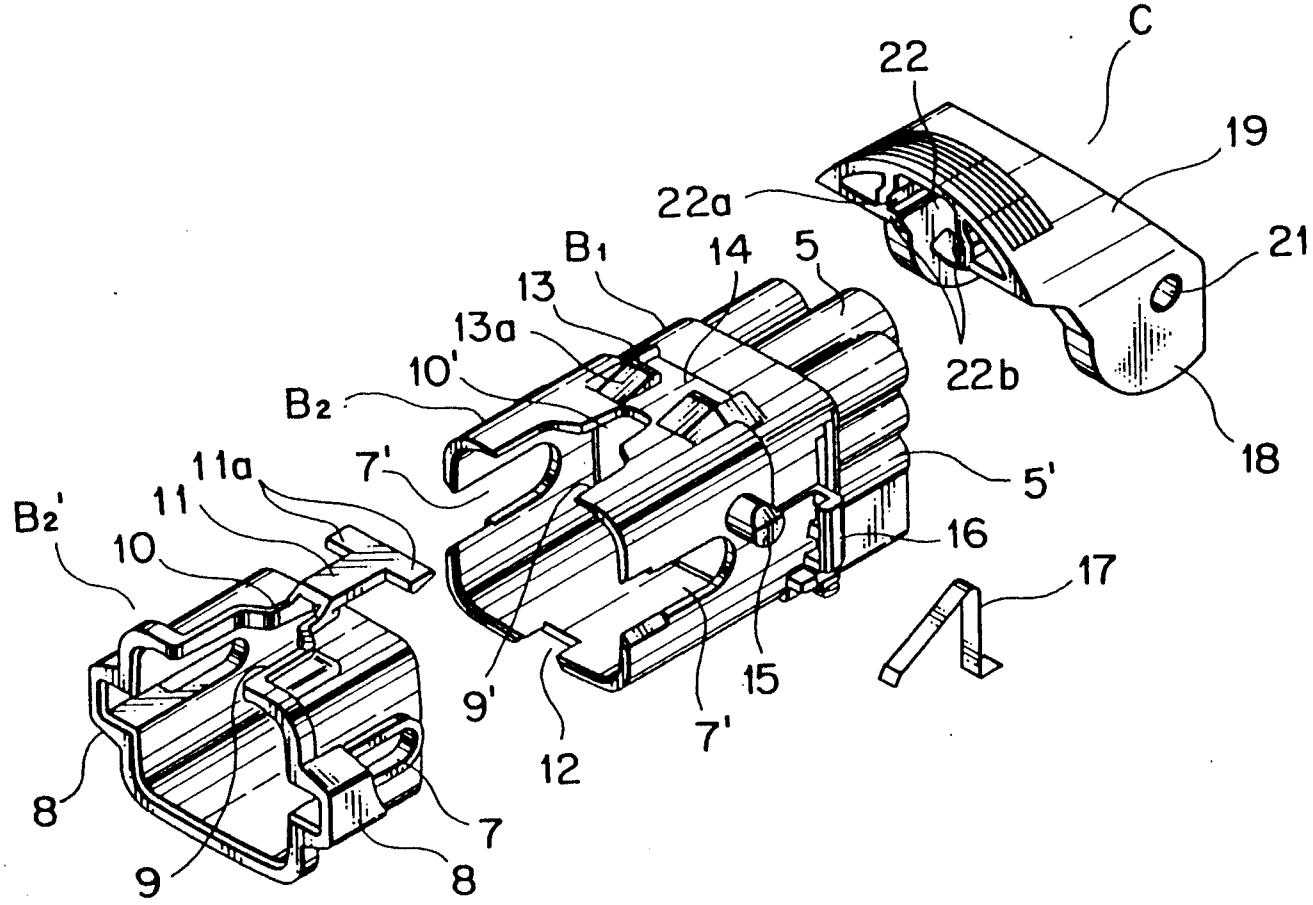
FIG. 2 is an exploded perspective view of the female housing of FIG. 1.
Figure 3:
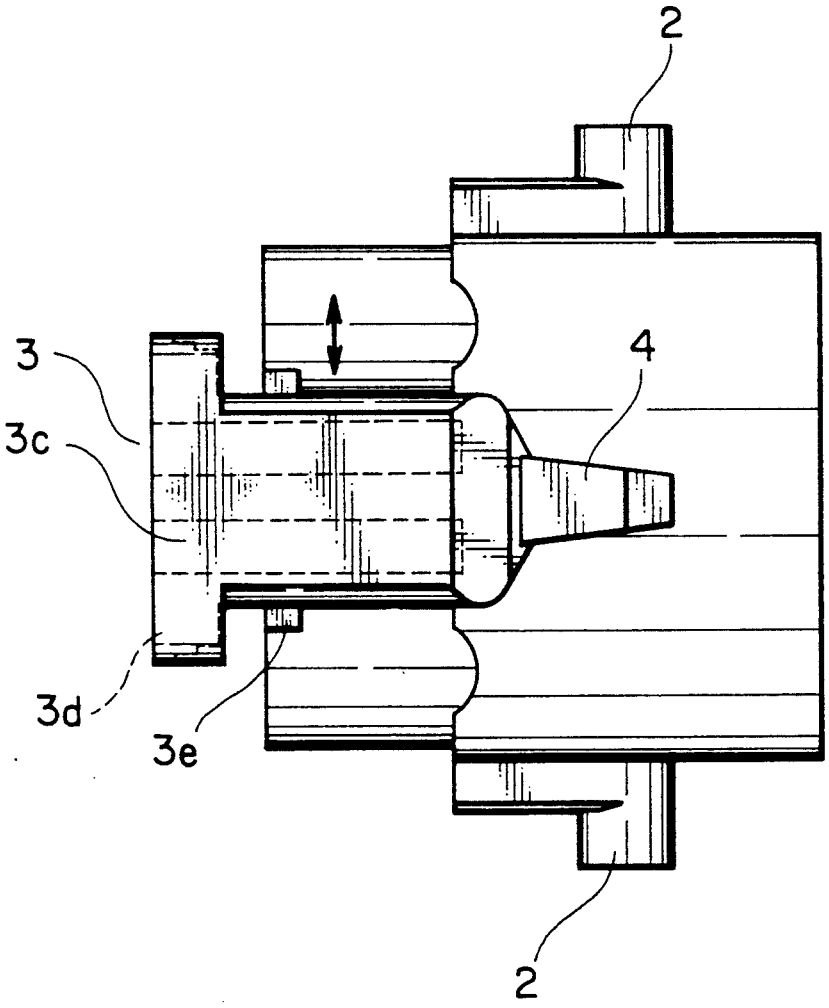
FIG. 3 is a plan view of the male housing of FIG.

Referring to FIGS. 1 to 3, denoted A is a synthetic resin-made male housing, B a synthetic resin-made female housing, and C a cam member rotatably mounted on the female housing B. The female housing B includes at its front half a hood portion for receiving the male housing A therein, which hood portion is formed of a main hood B2 and a subhood B2' so as to make the connector waterproof.

The male housing A has two sizes of terminal accommodating chambers 1 and 1' formed therein, one larger than the other, in which are accommodated female terminals (not shown). The male housing A has driven pins 2 projectingly formed on the opposite lateral walls for engagement with the cam member C and a locking portion 3 formed on the upper surface. The locking portion 3 includes a laterally-extended upright base plate 3*a* integrally formed on the upper surface of the male housing A, a center plate 3*b* extending rearwardly from the mid-portion of the base plate 3*a*, a cover plate 3*c* mounted on top of the base and center plates 3*a* and 3*b*, and a pair of resilient locking pieces 3*d*, 3*d* provided on the opposite sides of the center plate 3*b* such that they extend rearwardly from the respective lateral ends of the base plate 3*a* and in parallel with the center plate 3*b*. Each resilient locking piece 3*d* has on its outer wall near the free end an engagement projection 3*e* and at the free end a grip 3*f*. The resilient locking pieces 3*d*, 3*d* are resiliently displaceable in directions of the double arrow, parallel to the associated wall surface. A fitting guide projection 4, which also serves to prevent reverse fitting, is provided extending forwardly of the locking portion 3.

Figure 4:
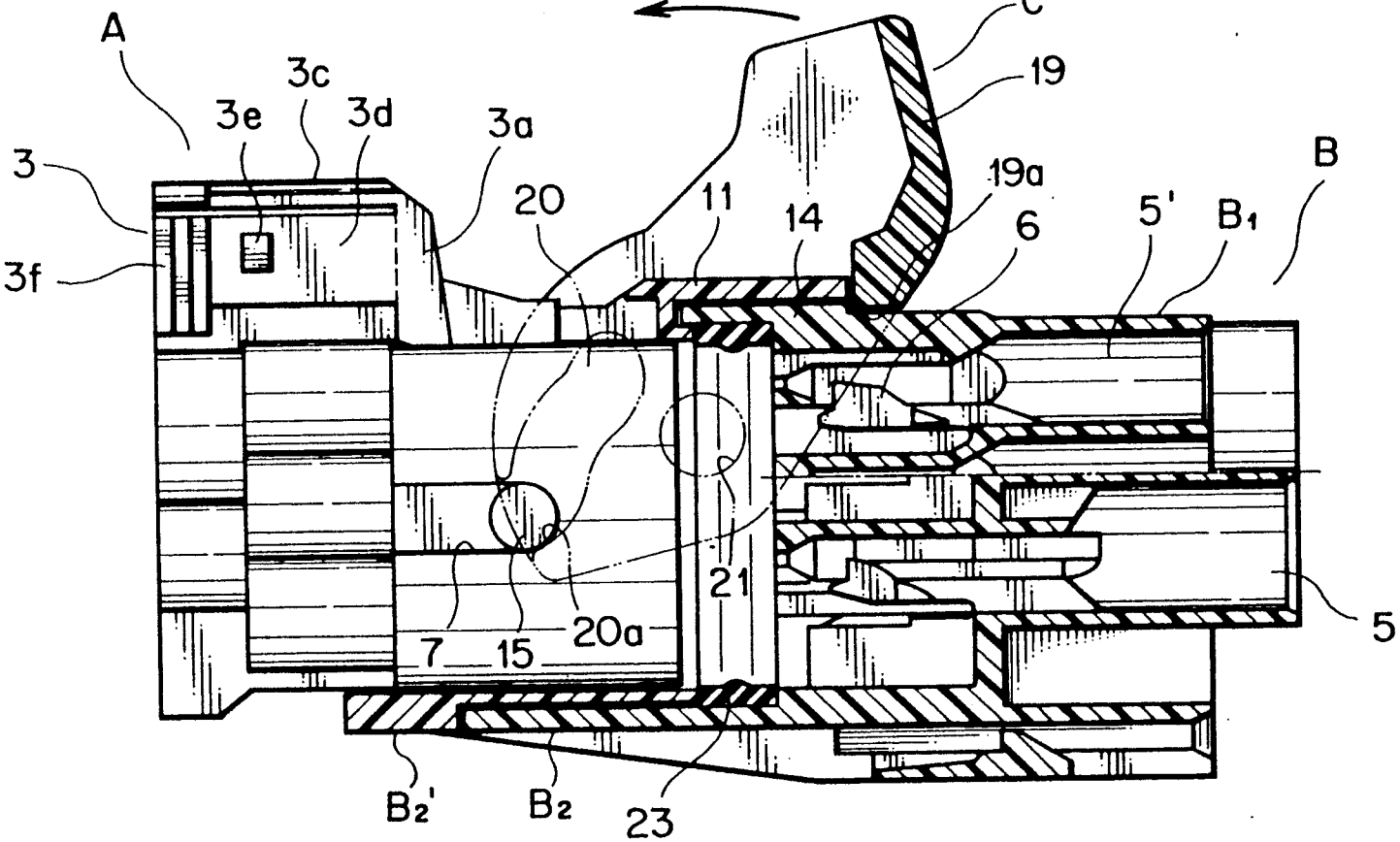
FIG. 4 is a cross sectional view showing essential portions of the female and male housings at the starting stage of the fitting process.
Figure 5:
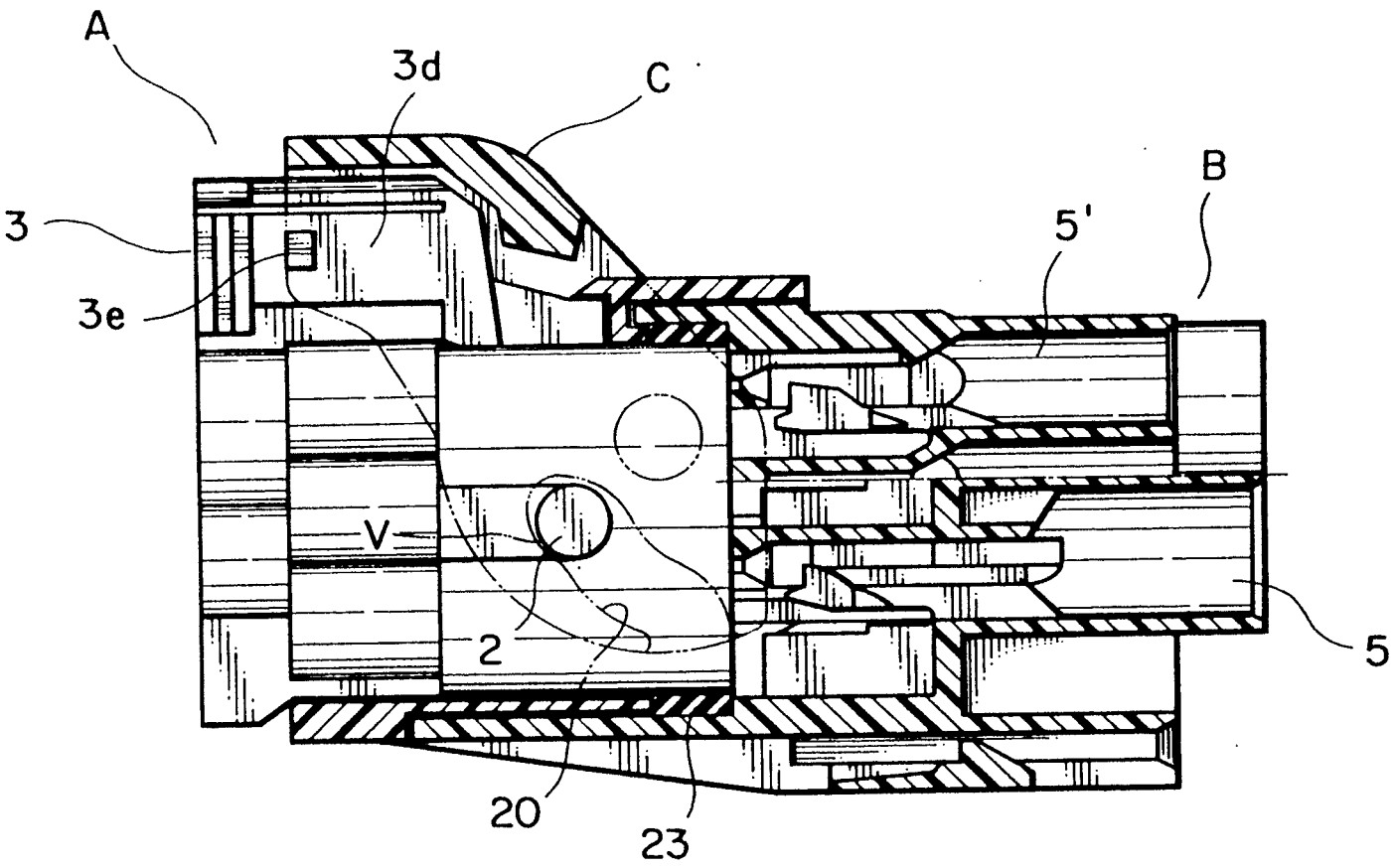
FIG. 5 is a cross sectional view showing essential portions of the female and male housings at the completed stage of the fitting process.

The female housing B includes a housing main body B1 with terminal accommodating chambers 5, 5' formed therein, which correspond to the above terminal accommodating chambers 1, 1', and a hood portion formed forwardly of the main body B1, which is composed of a main hood B2 and a sub-hood B2' joined to the main hood B2. A waterproof packing 23 is interposed between the main hood B2 and the sub-hood B2' as shown in FIGS. 4 and 5. The terminal accommodating chambers 5, 5' each contain a resilient engagement arm 6 for holding a male terminal (not shown) in position therein.

The sub-hood B2' has on the opposite lateral walls pin guide grooves 7 for the driven pins 2. Each pin guide groove 7 extends in a fitting direction of the housings and is provided at the entrance portion with a projectingly-formed groove cover 8. A notch 9 is formed to the upper wall of the sub-hood B2' for receiving the locking portion 3 of the male housing A and a notch 10, smaller in width than the notch 9, is formed continuous with the notch 9 for receiving the fitting guide projection 4. The sub-hood B2' further comprises a resilient locking plate 11 projecting forwardly of the notch 10, the locking plate 11 being formed at its front end with locking claws 11*a* extending laterally in the opposite directions.

The main hood B2 is next larger in size than the sub-hood B2' so as to have the latter inserted therein. The main hood B2 includes in the opposite lateral walls pin guide grooves 7' corresponding to the pin guide grooves 7 of the sub-hood B2' and in the upper wall notches 9' and 10' corresponding to the notches 9 and 10. Further provided on the upper wall of the main hood B2 are detents 13 and a locking seat 14 for engagement with the resilient locking plate 11. The detents 13—each having on its front side a guiding slope 13*a* for the associated locking claw 11*a*—are located on the opposite sides of a position behind the notch 10'. On the opposite lateral walls, the main hood B2 has supporting shafts 15 for the cam member C projectingly formed at a position above the end portions of the pin guide grooves 7' and spring engagement portions 16 formed rearwardly of the supporting shafts 15, adjacent the housing main body B1.

When the sub-hood B2' is inserted into the main hood B2, the locking claws 11*a* of the resilient locking plate 11 come into sliding contact with the respective guiding slopes 13*a* of the detents 13 so that they are resiliently displaced upwardly until they pass over the detents 13, at which the locking claws 11*a* return to their normal position to engage with the detents 13 and lock the sub-hood B2' to the main hood B2. When thus locked, the notches 9, 10 and the pin guide grooves 7 of the sub-hood B2' are respectively aligned with the notches 9', 10' and the pin guide grooves 7' of the main hood B2.

The cam member C is provided in a roughly gate-like configuration and comprises a pair of levers 18, 18 each including a cam groove 20 (FIG. 4) and a shaft-receiving hole 21, and a lever handle 19 connecting the levers 18. The cam groove 20 of each lever 18 is formed by two parallel lines that terminate in the inner surface of the lever 18. In the inner surface portion of the lever handle 19 is formed a recess 22 for receiving the locking portion 3 therein and on the opposite walls defining the recess 22 are formed, along with recessed wall portions 22*a*, engagement portions 22*b* for engagement with the engagement projections 3*e* of the resilient locking pieces 3*d*.

The cam member C is rotatable with respect to the female housing B when the shaft-receiving holes 21 of the levers 18 are fitted over the respective supporting shafts 15. The ends of the wedge-shaped plate spring 17 are respectively secured to the spring engagement portion 16 and adjacent the end portion of the cam groove 20 so that, as shown in FIGS. 1 and 4, the cam member C (or its lever handle 19) normally assumes an upright opened posture with respect to the hood B2 with the rear edge 19*a* of the lever handle 19 leaning against the upper wall of the female housing B at a position behind the locking seat 14. In this upright opened state, the entrance portion 20*a* of the cam groove 20 is located in alignment with the pin guide grooves 7 and 7' of the sub- and main hoods B2' and B2.

With the construction as mentioned above, if the male housing A is inserted into the hood portion of the female housing B (which is constituted by the sub- and main hoods B2' and B2), the driven pins 2 advance into the associated pin guide grooves 7 (and 7') until they reach the entrance portions 20*a* of the cam grooves 20 as shown in FIG. 4. When the cam member C is rotated, in this condition, in the direction of the arrow, the driven pins 2 are drawn toward the side of the female housing B to eventually put the female and male housings A and B in a fully fitted state as shown in FIG. 5, in which the female and male terminals accommodated in the respective terminal accommodating chambers 1, 1' and 5, 5' are also fully connected with each other. The latter, however, is not shown in the drawing to avoid drawing complexity.

More specifically, on rotation of the cam member C in the direction of the arrow in FIG. 4, the engagement portions 22*b* formed on the opposite sides of the recess 22 of the cam member C come into sliding contact with the associated engagement projections 3*e* of the locking portion 3 and resiliently displace the pair of resilient locking pieces 3*d*, 3*d* toward each other until the engagement portions 22*b* pass over the engagement projections 3*e*, at which the resilient locking pieces 3*d* resiliently outwardly return to their normal position to bring the engagement projections 3*e* into engagement with the engagement portions 22*b* and lock the cam member C as shown in FIG. 5. Thus, the cam member C is locked to the locking portion 3, while at the same time locking together the female and male housings A and B.

Figure 6:
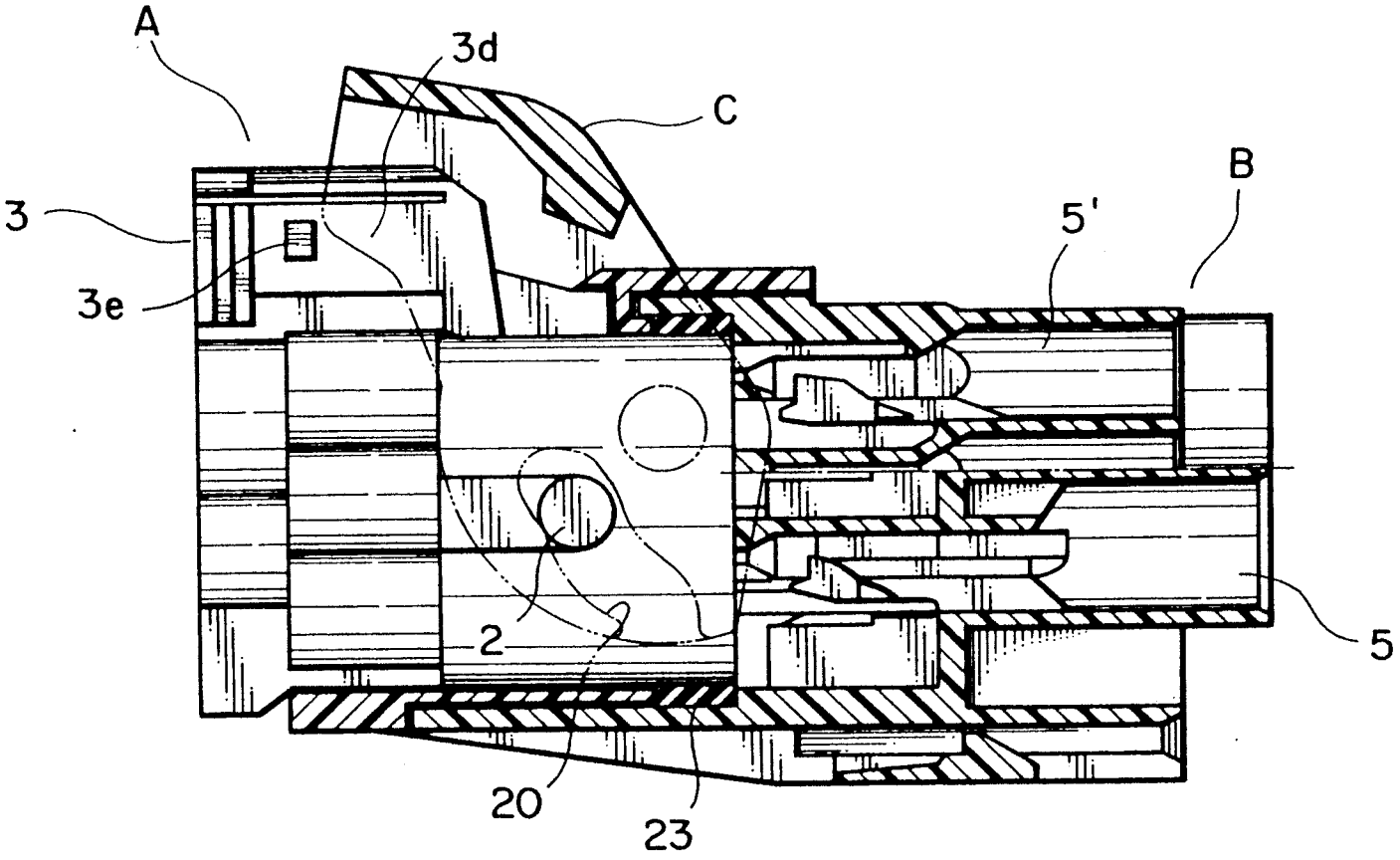
FIG. 6 is a cross sectional view showing essential portions of the female and male housings with the cam member opened from the fitting completed position of FIG. 5 to the starting position for separating the housings.
Figure 7:
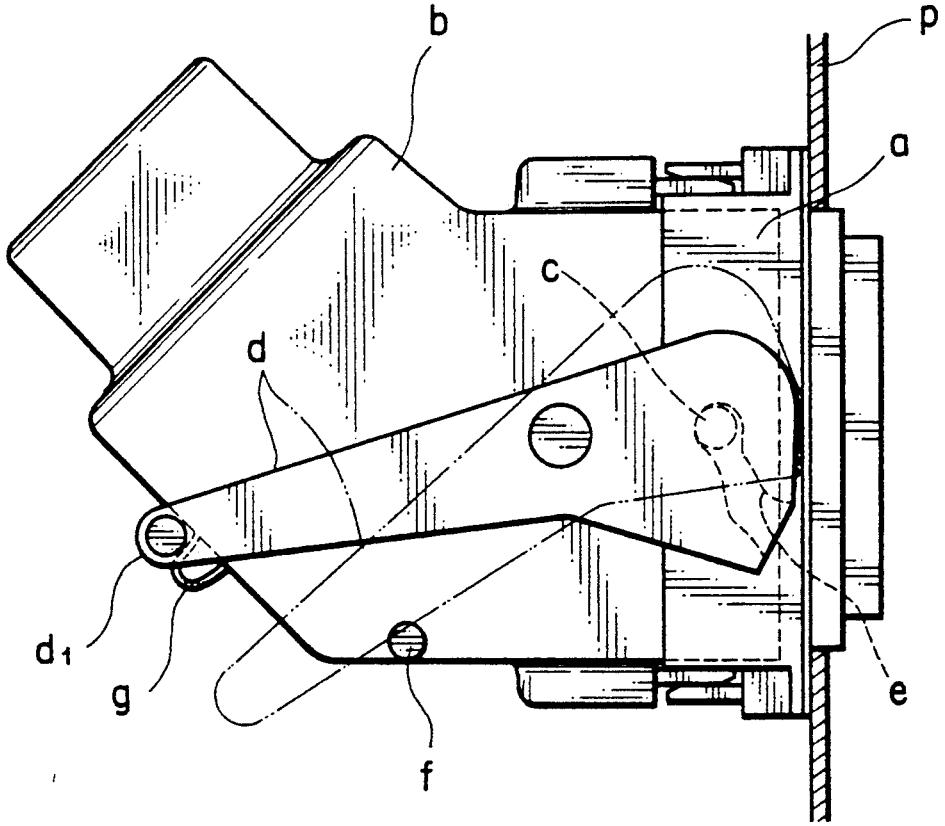
FIG. 7 PRIOR ART
FIG. 7 is a view illustrating a conventional low-operating-force connector.

To separate the female and male housings A and B, as is apparent from FIG. 1, the pair of resilient locking pieces 3*d*, 3*d* are moved toward each other by pressing at the grips 3*f*, 3*f* with fingers, and the engagement projections 3*e* and the engagement portions 22*b* are disengaged from each other. At that time, slight play (clearance) V between the cam groove 20 and the driven pin 2, visible in FIG. 5, allows the cam member C to be raised upwardly by the resilient action of the plate spring 17 into a slightly opened starting position for separating the female and male housings as shown in FIG. 6. Thereafter, the cam member C is rotated by hand in the opposite direction to the arrow in FIG. 4 to further proceed with separation. Thus, the cam member C can be very easily operated with one hand to effect unlocking and thus the operations in a confined space are facilitated.

While in the above embodiment, the hood portion of the female housing B is composed of a sub-hood B2' and a main hood B2, it may be composed of a single hood unless a waterproof connector is to be manufactured. Further, in place of the plate spring 17, another form of spring such as a helical spring may be employed insofar as it can normally urge the cam member C into an upright opened posture.

As mentioned above, according to the present invention, in a low-operating-force connector that makes use of rotation of a cam member, locking by the cam member is very easily cancelled using one hand and, as a result, operations in a confined space are facilitated. Since the cam member is urged by the resilient action of the spring to assume an upright opened posture in normal conditions such as prior to coupling of the housings and during no use of the connector, and the cam groove and the pin guide groove are kept in alignment with each other, the male housing can be directly fitted as it is into the female housing. Further, since the cam member is locked for the first time when the female and male housings are completely fitted with each other, completion of their coupling can be readily ascertained from outside by seeing whether or not the cam member is engaged with the locking portion of the male housing. Thus, incomplete coupling of the housings is prevented.

Having now fully described the invention, it will be apparent to one of ordinary skill in the art that many changes and modifications can be made thereto without departing from the spirit and scope of the invention as set forth herein.

What is claimed is:

1. A low-operating-force connector comprising: a female housing and a corresponding male housing;

driven pins provided on opposite sides of one of said housings;

pin guide grooves formed on opposite sides of the other of said housings for guiding said driven pins;

a cam member substantially in a gate-like configuration comprising a pair of levers each having a cam groove formed therein, and a lever handle interconnecting said levers, said levers movable mounted on a respective one of said opposite sides of said other housing with their cam grooves in alignment with said pin guide grooves so that through rotation of said cam member or levers, said driven pins are brought into and out of engagement with said levers to lock together or unlock said female and male housings;

a pair of resilient locking pieces provided on said one housing, each having on its outer periphery an engagement projection and an outwardly presented grip at a free end thereof projecting beyond said lever handle when the female and male housings are locked, said locking pieces being resiliently displaceable toward each other in a direction parallel to a wall surface on which the pair of locking devices are provided;

a pair of engagement portions provided on said lever handle of the cam member for engagement with said engagement projections of the resilient locking pieces; and spring means disposed between said levers of the cam member and said other housing for normally urging said cam member into an upright opened position, whereby when said female and male housing are completely fitted with each other through rotation of said cam member to a closed leaning position against said one housing, said engagement projections of the resilient locking pieces engage with said engagement portions to lock said cam member in the closed position, and whereby when said engagement portions are released from said engagement projections of the resilient locking pieces by manual displacement of the locking pieces toward each other, said cam member is opened by a resilient action of said spring means up to a starting position for separating said female and male housings.

2. A low-operating-force connector as claimed in claim 1, wherein said first-named housing is said male housing and said second-named housing is said female housing.

3. A low-operating-force connector as claimed in claim 1, wherein said second-named housing comprises a hood portion into which said first-named housing is inserted, said hood portion being composed of a main hood and a sub-hood closely fitted in the main hood with a waterproof packing interposed therebetween.

4. A low-operating-force connector as claimed in claim 1 further including a cover plate on said one housing, said cover plate lying over said resilient locking pieces in an orientation parallel to the direction of locking piece displacement.

* * * * *